United States Patent [19]

Jungesjo

[11] 4,155,237

[45] May 22, 1979

[54] MACHINE FOR SPLINING THIN-WALLED POWER TRANSMISSION MEMBERS

[75] Inventor: Harald N. Jungesjo, Rochester, Mich.

[73] Assignee: Anderson-Cook, Inc., Fraser, Mich.

[21] Appl. No.: 871,319

[22] Filed: Jan. 23, 1978

[51] Int. Cl.[2] ..... B21D 9/14; B21D 53/28

[52] U.S. Cl. ..... 72/88; 72/419

[58] Field of Search ..... 72/88, 90, 124, 67, 72/419; 29/159.2

[56] References Cited

U.S. PATENT DOCUMENTS

| | | | |
|---|---|---|---|
| 3,299,680 | 1/1967 | Thompson | 72/6 |
| 4,028,922 | 6/1977 | Killop | 72/88 |

*Primary Examiner*—Milton S. Mehr

*Attorney, Agent, or Firm*—Reising, Ethington, Barnard, Perry & Brooks

[57] ABSTRACT

The machine disclosed includes apparatus for splining thin-walled sleeves of power transmission members that are mounted on a toothed mandrel between a pair of toothed dies by an automatic loader which also removes the members from the mandrel after the splining. Loading and unloading members of the loader are moved axially along the axis of mandrel rotation by associated actuating cylinders to move members to be splined from an indexer onto the mandrel and to move the members after splining from the mandrel back to the indexer. Clamping surfaces on the end of the mandrel and a rotatable clamp of the loading member position the sleeve of a member being splined over the mandrel teeth. The unloading member is received within a central opening of the mandrel and has an annular centering surface that properly locates the member being splined. In one preferred embodiment, the toothed dies comprise straight racks that are slidably movable on opposite sides of the mandrel with one of the racks fixed to a timing rack which meshes with a timing gear on the spindle to coordinate the mandrel rotation with rack movement. In another preferred embodiment, the toothed forming faces of the dies are curved.

32 Claims, 9 Drawing Figures

MACHINE FOR SPLINING THIN-WALLED POWER TRANSMISSION MEMBERS

BACKGROUND OF THE INVENTION

1. Field of the Invention

This invention relates to a machine having apparatus for splining thin-walled sleeves of power transmission members.

2. Description of the Prior Art

U.S. Pat. Nos. 3,982,415; 4,028,922; and 4,045,988, all of which are assigned to the assignee of the present invention, disclose machine splining apparatus capable of forming splines in thin-walled sleeves of power transmission members. Clutches of vehicle automatic transmissions include hubs with thin-walled sleeves that must be splined in order to rotatably couple the hubs to stacked clutch discs. It is important that the splines formed are uniform in size, spacing, and shape and that the sleeve in which the splines are formed is not distorted from a round condition during the splining. With the apparatus disclosed by these prior patents, it is possible to roll the splines with the member mounted on a toothed mandrel between a pair of toothed dies on opposite sides on the mandrel. Meshing of the die mandrel teeth with the power transmission sleeve located therebetween forms the splines without excessive work hardening of the metal material.

Prior to the introduction of the spline rolling process discussed above, impact splining was the only practical way to form splines on thin-walled power transmission members such as clutch hubs. This impact splining is performed by mounting the clutch hub on a mandrel between two hammer-like dies located in a 180° opposed relationship to each other. Simultaneous rapid movement of the disc toward each other bangs the clutch hub sleeves against the mandrel to form the splines. A number of strokes are performed to form each spline, proceeding from an end wall at one partially closed end of the sleeve toward an open end of the hub. After each spline is formed, the mandrel is rotated slightly and the next pair of adjacent splines are then formed. After one half of a revolution of the mandrel, the clutch hub is completely splined and can be removed from the mandrel. The splines formed by this process become work hardened during the impacting and are thus more brittle and less tough than the metal material prior to the splining. Also, axial deformation of the sleeve during the impact splining distorts the flatness of the hub end wall where the hub is usually seated for mounting during use. Also, the time required to completely spline a clutch hub with this impacting operation is considerably longer than that required with the rolling process described above. Of course, it is desirable to decrease the time for splining each hub and the amount of labor involved in order to reduce the per unit cost.

SUMMARY OF THE INVENTION

An object of the present invention is to provide improved machine apparatus for splining thin-walled annular sleeves of power transmission members and including a loader that automatically mounts a member to be splined on a toothed mandrel between a pair of toothed dies and automatically removes a splined member from the mandrel after the dies have been moved to mesh the teeth thereof and the mandrel teeth with the sleeve of the member splined between the meshing teeth.

Another object of this invention is to provide improved machine apparatus for splining thin-walled annular sleeves of power transmission members and including a loader having loading and unloading members mounted for coordinated axial movement along a central axis of rotation of a toothed mandrel so as to automatically mount a member to be splined on the mandrel between a pair of toothed dies and so automatically remove a splined member from the mandrel after the dies have been moved to mesh the teeth thereof and the mandrel teeth with the sleeve of the member splined between the meshing teeth, and wherein the member being splined is clamped between a clamping surface on an end of the mandrel and a clamping surface on a rotatable clamp of the loading member.

In carrying out the above objects as well as other objects of the present invention, preferred embodiments of the machine apparatus include an antifriction thrust bearing connection for rotatably mounting the clamp on the loading member. An annular flange of the loading member is positioned between a pair of antifriction thrust bearings in the disclosed construction of the connection between the rotatable clamp and the loading member. An actuator for the loading member is perferably embodied as a hydraulic cylinder connected to the loading member to provide the axial movement thereof along the axis of mandrel rotation. An antifriction spindle assembly includes a spindle that mounts the mandrel and the unloading member for rotation with each other. The unloading member also has an actuator preferably embodied as a hydraulic cylinder which is coupled to a shaft of the unloading member by an antifriction thrust bearing to provide axial movement of the unloading member guided by a bushing. Aligned openings in the mandrel and the spindle of the antifriction spindle assembly receive the unloading member which moves along the axis of mandrel rotation.

An indexer of the apparatus feeds members to be splined between the rotatable clamp of the loading member and the mandrel and also receives the splined members after the splining. A guide preferably of a tubular form extends between the indexer and the mandrel to guide the members during loading and unloading. The clamping surfaces on the loading member clamp and the mandrel preferably have annular shapes aligned with opposite ends of the tubular guide.

A centering surface on an enlarged end of the unloading member insures proper alignment of the members on the mandrel during the splining. An axial depression in the mandrel within the annular clamping surface thereof receives the enlarged end of the unloading member as the splining is being performed. Proper clamping location between the mandrel and the clamp of the loading member is provided by a centering mechanism including a hole in the enlarged end of the unloading member and a spring biased probe on the rotatable clamp of the loading member within the annular clamping surface of the clamp. During axial movement between the indexer and the mandrel, the member being loaded or unloaded is clamped between the rotatable clamp of the loading member and the enlarged end of the unloading member. Associated pairs of adjustable limit switches for both the loading and unloading members cooperate to sense the extremes of axial movement thereof, and the switches are coupled to the actuator cylinders thereof to control cylinder operation.

One preferred embodiment of the machine apparatus disclosed has the toothed dies constructed as racks having straight toothed forming faces. The straight racks are slidably driven on opposite sides of the mandrel with one of the racks fixed to a timing rack that meshes with a timing gear rotatably supported and fixed to the mandrel by the spindle of the antifriction spindle assembly. A central hole of the timing gear is aligned with the central hole of the mandrel and receives a mounting end of the spindle whose central opening receives the unloading member. Antifriction bearings spaced along the axis of mandrel rotation support the spindle on the spindle housing that is fixed to the base of the machine on which slide tables supporting the die racks are movable. A shaft of the unloading member extends through the spindle opening and is connected to a coupling member by the thrust bearing thereof with the coupling member in turn being connected to the hydraulic cylinder that actuates the axial unloading member movement. A switch tripper on the coupling member actuates the adjustable limit switches that sense the extremes of axial unloading member movement.

In another preferred embodiment disclosed, the toothed forming faces of the dies are curved and the dies are supported on rotatable tool mounts driven by a drive mechanism that also drives the spindle on which the mandrel is mounted and through which the unloading member extends. A differential of the drive mechanism drives the mandrel in coordination with the rotatable driving of the tool mounts on opposite sides of the mandrel. One side gear of the differential is coupled to a drive sleeve driven off of one of the tool mounts and a second side gear is coupled to the spindle to drive the mandrel from the differential. Both side gears have central openings that receive the spindle and a shaft of the unloading member which extends through an opening of the spindle, and the unloading member is thus movable axially along the axis of mandrel rotation within the spindle. Pinion gears are supported on a differential of the housing and meshed with the side gears so as to normally rotate the spindle in coordination with the tool mounts. The differential housing is rotatably supported for adjustable movement and is rotated by a timing adjustment drive train to adjust the rotational position of the toothed mandrel with respect to the tool mounts. A gear of the timing adjustment drive train is fixed on the differential housing and meshed with another gear fixed on an adjustment shaft which has an end that can be rotated to provide the adjustable positioning of the mandrel. A brake normally fixes the adjustment shaft to prevent rotation of the differential housing during use while selectively releasing the shaft for the rotation that provides the adjustment. A switch tripper on the shaft of the unloading member provides switch actuation of the adjustable limit switches to sense the axial extremes of unloading member movement. Thrust bearings connect the shaft of the unloading member to the coupling member which is connected to the hydraulic cylinder actuator for moving the unloading member axially.

The objects, features, and advantages of the present invention are readily apparent from the following detailed description of the preferred embodiments taken in connection with the accompanying drawings.

DETAILED DESCRIPTION OF THE PREFERRED EMBODIMENTS

Figure 1:
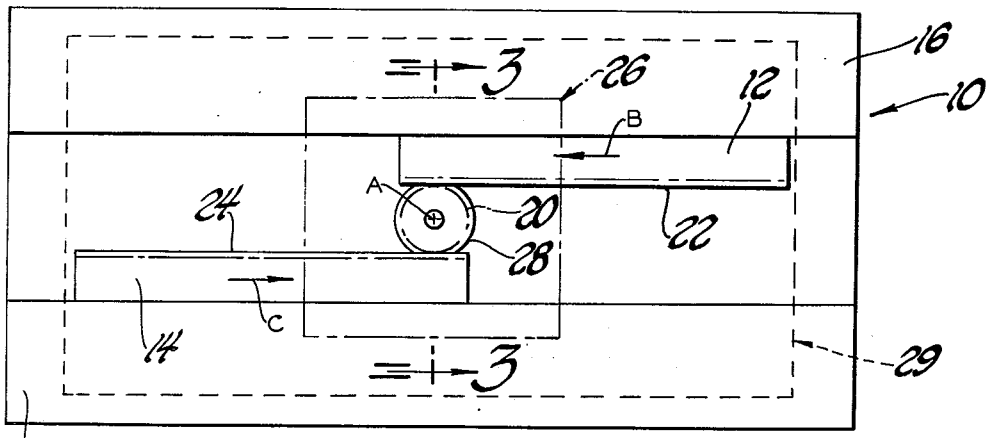
FIG. 1 is an elevation view in schematic illustrating one embodiment of machine apparatus that is contructed according to this invention.

A machine including one preferred embodiment of apparatus constructed according to the present invention is shown schematically in FIG. 1 with the machine apparatus indicated collectively by reference numeral 10. Upper and lower dies 12 and 14 of the machine apparatus are constructed as straight racks and are mounted by suitable unshown slide tables on upper and lower machine bases 16 and 18 above and below a toothed mandrel 20 which rotates about a central axis A. Toothed forming faces of straight shapes on the die racks 12 and 14 are shown schematically and indicated respectively by 22 and 24. An automatic loader 26 positions a power transmission member whose thin-walled sleeve 28 is to be splined over the toothed mandrel 20. Sleeve 28 has an annular shape and is engaged by the teeth of the forming faces 22 and 24 which are meshed with the teeth of the mandrel 20 with the sleeve therebetween so as to form splines in the sleeve as the meshing proceeds in a rolling manner. After the die racks 12 and 14 have been moved sufficiently far along arrows B and C to spline the total circumference of the sleeve 28, the die racks are driven in a reverse direction and disengage the splined sleeve 28 of the power transmission member which is then removed from the mandrel 20 by the loader 26 in a manner which is hereinafter described in greater detail. A schematically indicated drive mechanism 29 which drives the die racks 12 and 14 is of the type disclosed by U.S. Pat. No. 3,793,866, which is assigned to the assignee of the present invention and which is hereby incorporated by reference. Previously mentioned U.S. Pat. Nos. 3,982,415 and 4,028,922, which are hereby incorporated by reference, illustrate the thin-walled splining process involved and the preferred construction of the die rack teeth for forming the splines.

Figure 2:
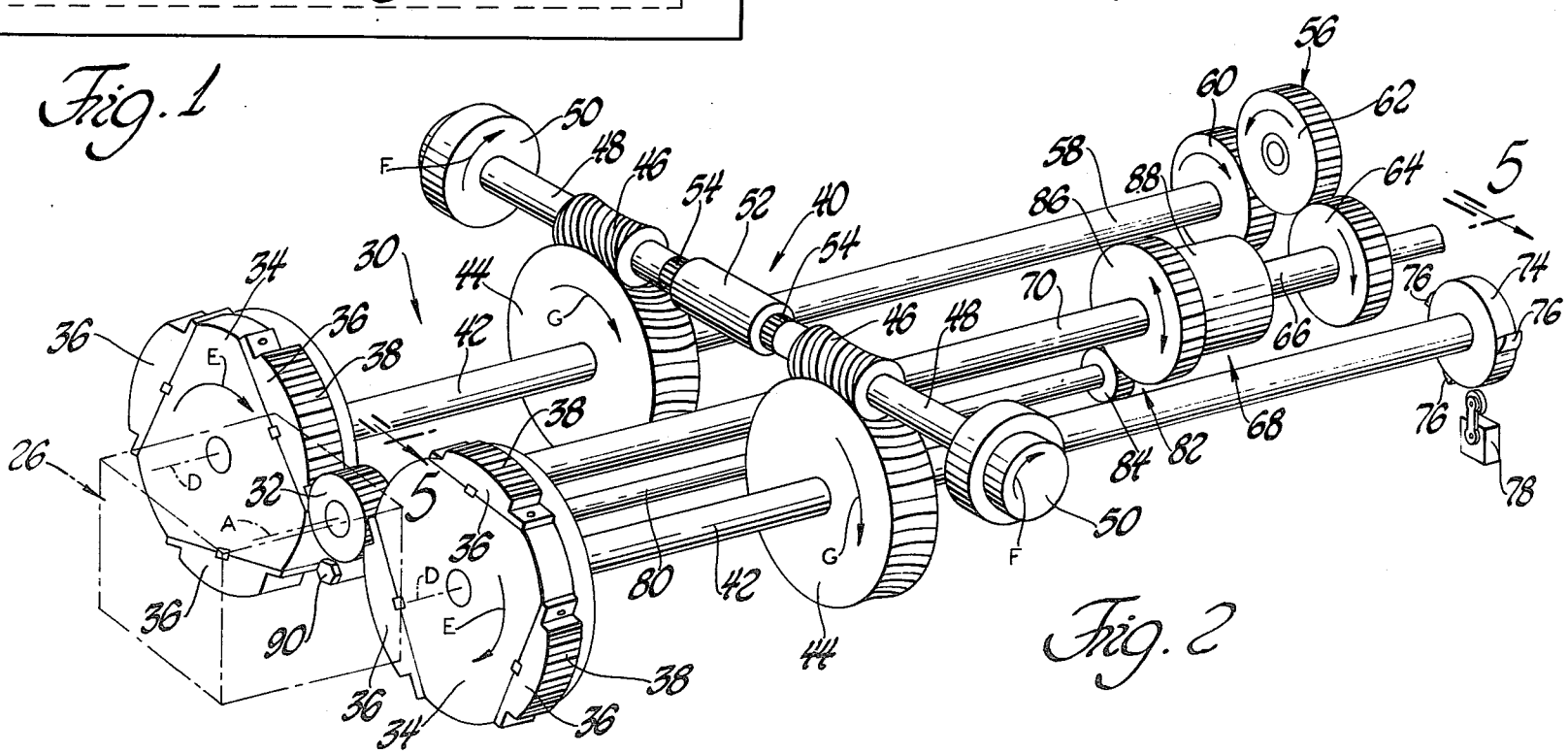
FIG. 2 is a schematic view of another embodiment of machine apparatus constructed according to the present invention.

Another preferred embodiment of machine apparatus constructed according to the present invention is shown schematically in FIG. 2 and indicated collectively by reference numeral 30. Machine apparatus 30 incorporates the loader 26 to mount and remove power transmission members to be splined on a toothed mandrel 32 which is rotatable about a central axis A. A pair of rotatable tool mounts 34 are mounted for rotation about spaced axes D on opposite sides of the mandrel axis A and support associated dies 36 having toothed forming faces 38 of curved shapes generated about the axes D. After the loader 26 has first mounted a power transmission member with its thin-walled annular sleeve over the toothed mandrel 32, a worm gear drive train collectively indicated by 40 rotates the tool mounts 34 as shown by curved arrows E to mesh the toothed forming faces 38 of a pair of cooperable dies and the mandrel teeth with the sleeve deformed therebetween so as to be splined.

Worm gear drive train 40 shown in FIG. 2 includes a pair of spaced shafts 42 each of which has one end fixed to one of the tool mounts 34 and another end fixed to an associated worm gear 44. A pair of worms 46 are supported on associated shafts 48 in meshing engagement with the worms 44 such that driving of the shafts by a pair of hydraulic motors 50 as shown by curved arrows F rotates the worm gears in the direction shown by curved arrows G to rotate the tool mounts in the direction of arrows E. The annular toothed faces of worm gears 44 are concave along the axial directions of their associated shafts 42 as are the worms 46 along the axial direction of their aligned shafts 48. This type of worm gear drive is referred to as being "double-enveloping" and provides area contact in driving the tool mounts 34 so as to provide precise splining. A coupling 52 interconnects splined ends 54 of the worm shafts 48 and allows the shafts 42 to be mounted for movement toward and away from each other so as to accommodate for splining of different sized sleeves. It should be noted that the machine structure for supporting the shafts 42 is illustrated and described more completely by the aforementioned U.S. Pat. No. 4,045,988 which is hereby incorporated by reference. Also, the configuration of the toothed forming faces 38 is also more fully disclosed and described in the aforementioned U.S. Pat. No. 4,028,922 which has been incorporated herein by reference.

Drive train 30 shown in FIG. 2 includes a timing gear drive train 56 driven by an extension 58 of one of the shafts 42. A gear 60 on the end of shaft extension 58 is meshed with a replaceable change gear 62 which is itself meshed with a third gear 64 fixed on a drive sleeve 66 connected to the input of a differential 68. A shaft-like spindle 70 has one end connected to the output of the differential 68 and another end that supports the mandrel 32. During rotatable driving of the tool mounts 34 by the hydraulic motors 50 through the worm gear sets, the timing gear drive 56 drives the mandrel 32 through the differential 68 in a coordinated manner with the dies 36 supported on the tool mounts so as to insure the meshing that forms the thin-walled splined between the die and mandrel teeth. The other shaft 42 includes an extension 72 that supports a plate 74 on which three dogs 76 are mounted. After each one-third revolution of the tool mounts 34 and the splining performed by one of the cooperable pairs of dies 36 supported on the tool mounts, one of the dogs 76 operates a limit switch 78 that terminates the driving rotation while the loader 26 removes the power transmission member which has just been splined from the mandrel 32 and loads another member to be splined onto the mandrel. Between cycles at selected intervals or upon setup of any particular splining operation, a shaft 80 of a timing adjustment drive train 82 is rotated to adjust the rotational position of the mandrel 32 with respect to the tool mounts 34. One end of shaft 80 is connected to a gear 84 meshed with a gear 86 that is fixed to a housing 88 of the differential 68. Another end of shaft 80 has a hexagonal head 90 that is rotated by a suitable wrench to provide the timing adjustment of the mandrel 32 through the differential.

A more detailed description of the schematically indicated loader 26 as it operates with both the machine apparatus 10 of the FIG. 1 embodiment and the machine apparatus 30 of the FIG. 2 embodiment follows. The more complete description of the loader function and structure is combined with more complete descriptions of the two preferred embodiments of the machine apparatus.

Referring collectively to FIGS. 3A, 3B, 3C, and 3D arranged alphabetically from left to the right, the loader 26 includes a loading member 92 and an unloading member 94 that extend along the central axis A of mandrel rotation. A clamp 96 is mounted for rotation on the loading member 92 and cooperates with an enlarged end 98 of the unloading member 94 to position thin-walled power transmission members to be splined, such as the clutch hub 100 shown in FIG. 3C, and to also remove the clutch hub from the mandrel after the splining is completed. An indexer indicated generally by 102 feeds the clutch hubs 100 between the loading and unloading members 92 and 94 for axial movement onto the mandrel 20 and receives the splined members after completion of the spline rolling process. As will be more fully hereinafter described, a flat end wall 104 of the clutch hub 100 is clamped between the clamp 96 and the mandrel 20 as an annular thin-walled sleeve 106 of the clutch hub is positioned over teeth 108 of the mandrel 20 so that meshing of the teeth along the die rack forming faces 22 and 24 and the mandrel teeth with the sleeve therebetween causes sleeve deformation that forms the splines.

The loading member 92 (FIGS. 3C and 3D) of loader 26 is mounted by a stationary machine base bracket 110 on a horizontal bracket plate 112 which is reinforced by a generally triangular plate 114 welded between the bracket 110 and the plate 112. An elongated sleeve housing 116 is secured on the horizontal bracket plate 112 in any suitable manner and includes a central opening 118 whose opposite ends include bushings 120 that slidably support the loading member 92 for movement along the axis A of mandrel rotation. As previously described, the clamp 96 is rotatably supported on the left end of the loading member 92 extending outwardly from the housing 116. The right end of the loading member 92 is secured by bolts 122 to a plate 124 connected to an actuator in the form of a hydraulic cylinder 126. End rings 128 of cylinder 126 include mounting lugs 130 secured by bolts 132 to the upper side of the housing 116 in which the loading member is supported for slidable movement along the axis of mandrel rotation. A piston 132 is sealingly slidable within an internal bore of cylinder 126 and is secured to a connecting rod 134 that extends out through a sealed opening to the right for securement to the plate 124 by the threaded stud and nut connection 136. Hydraulic fluid supplied to the cylinder 126 at the right side of piston 132 slides the piston to the left and pulls the rod 134 inwardly so that the loading member 92 is thereby moved to the left along the axis of mandrel rotation in order to provide loading of a clutch hub 100 on the mandrel 20. After splining of the clutch hub 100 is completed, hydraulic fluid is supplied to the cylinder 126 at the left side of the piston 132 and the fluid on its right side is fed through a control valve to a reservoir so that the piston moves to the right. This movement of the piston 132 to the right then pushes its connecting rod 134 outwardly to the right so that the loading member 92 moves to the right and pulls the clamp 96 away from the mandrel. As is described more completely later, the unloading member 94 is also then moved to the right so that its enlarged end 98 cooperates with the clamp 96 in removing the clutch hub from the mandrel 20. Release of the fluid to the right of the piston 132 for flowing to the reservoir is limited to a certain extent by the control valve so that there is some resistance of the loading member 92 in moving to the right in order to maintain clamping pressure between the clamp 96 thereof and the enlarged end 98 of the unloading member 94.

Figure 3A:
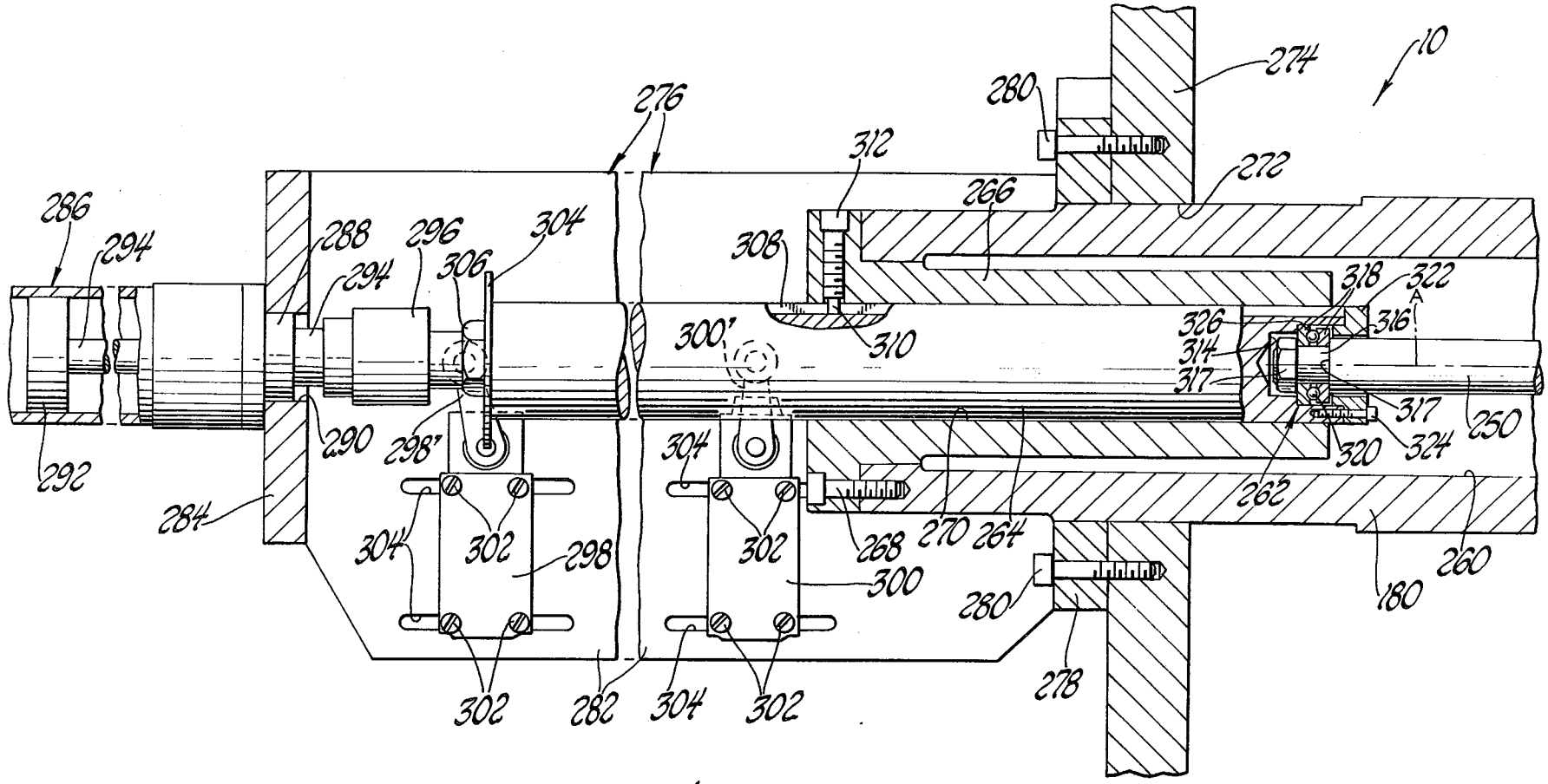
FIGS. 3A, 3B, 3C, and 3D placed together alphabetically from the left to the right collectively show a view taken in section along line 3—3 of FIG. 1 and further illustrate the machine apparatus embodied thereby.
Figure 3B:
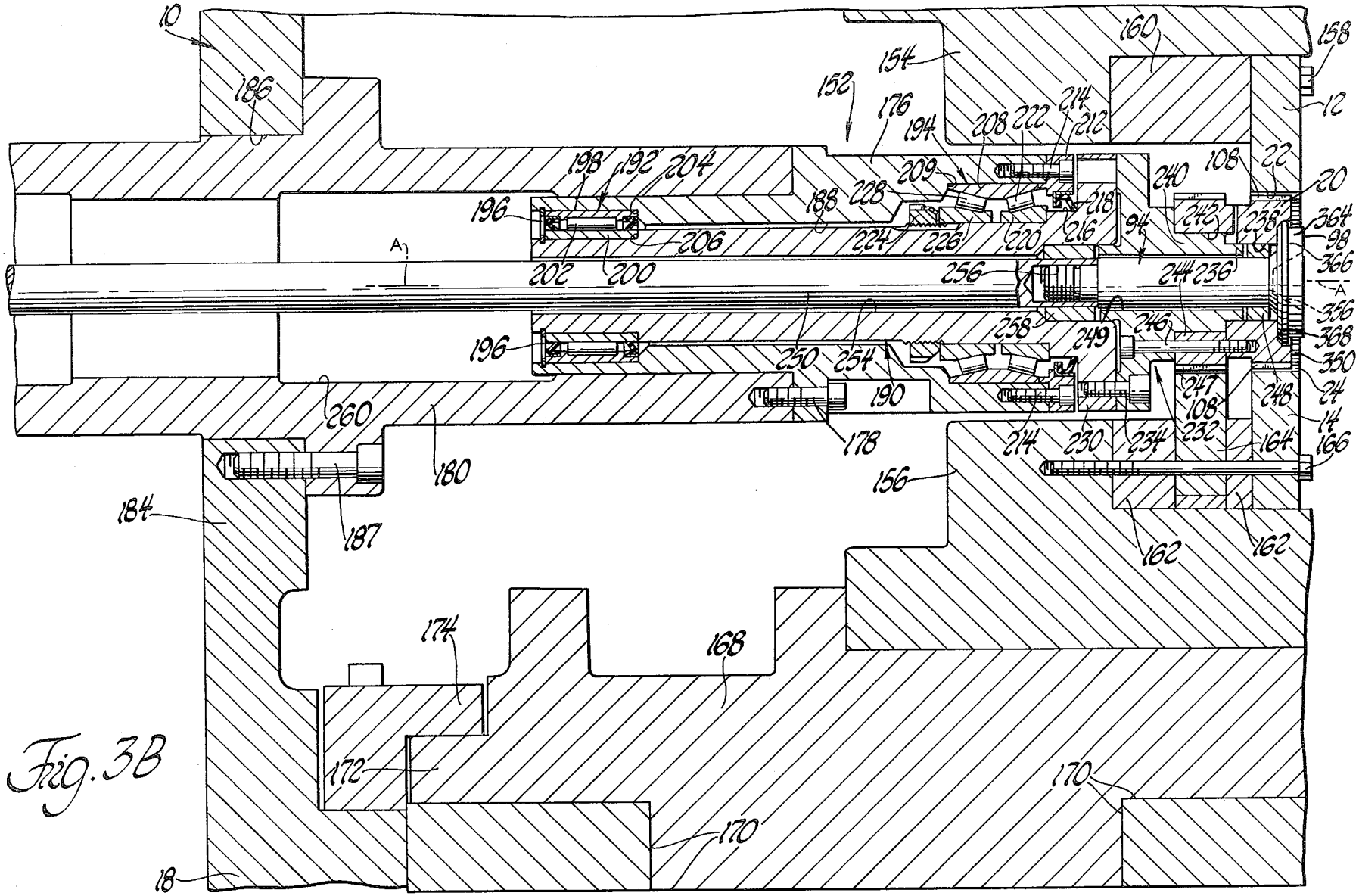
Figure 3C:
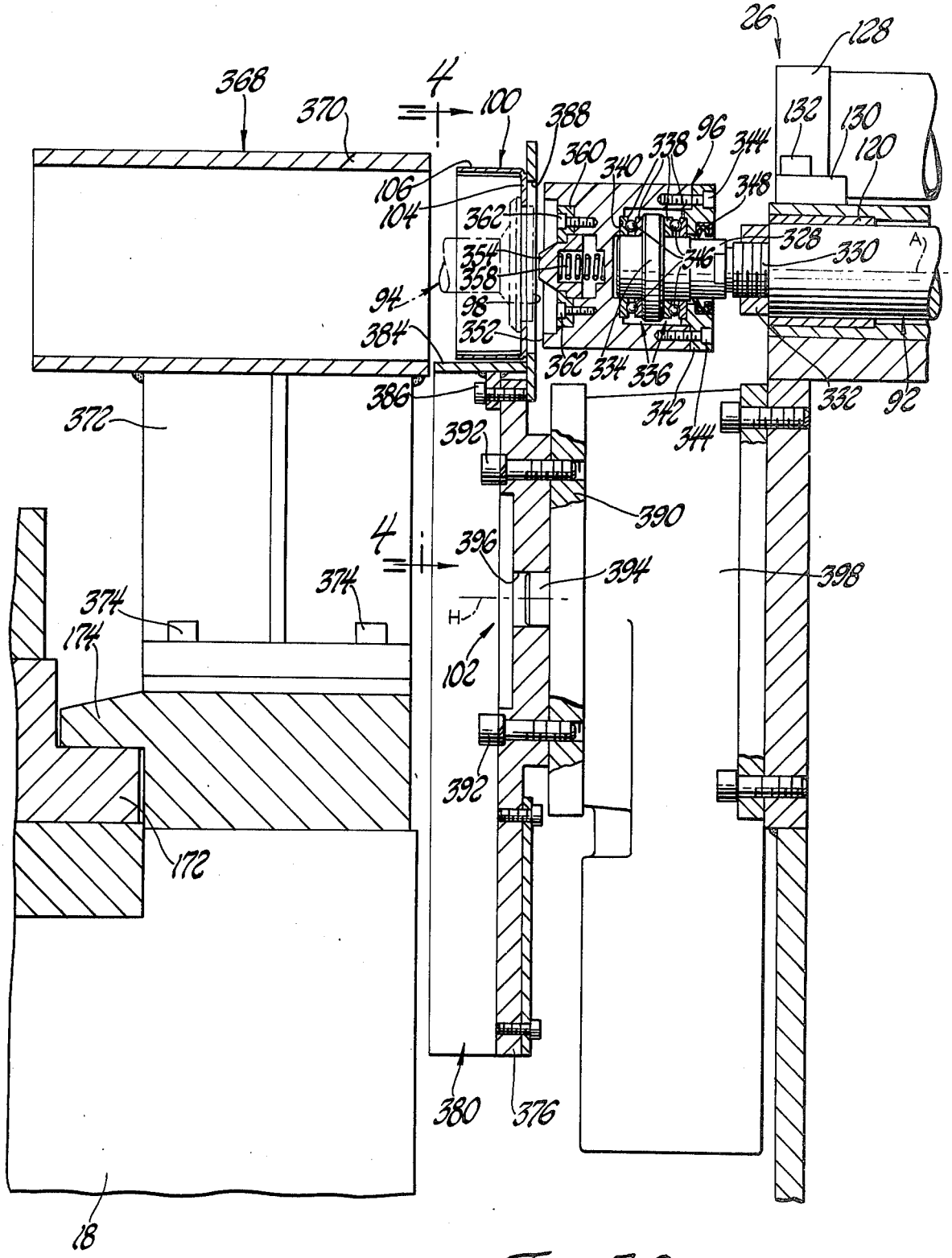
Figure 3D:
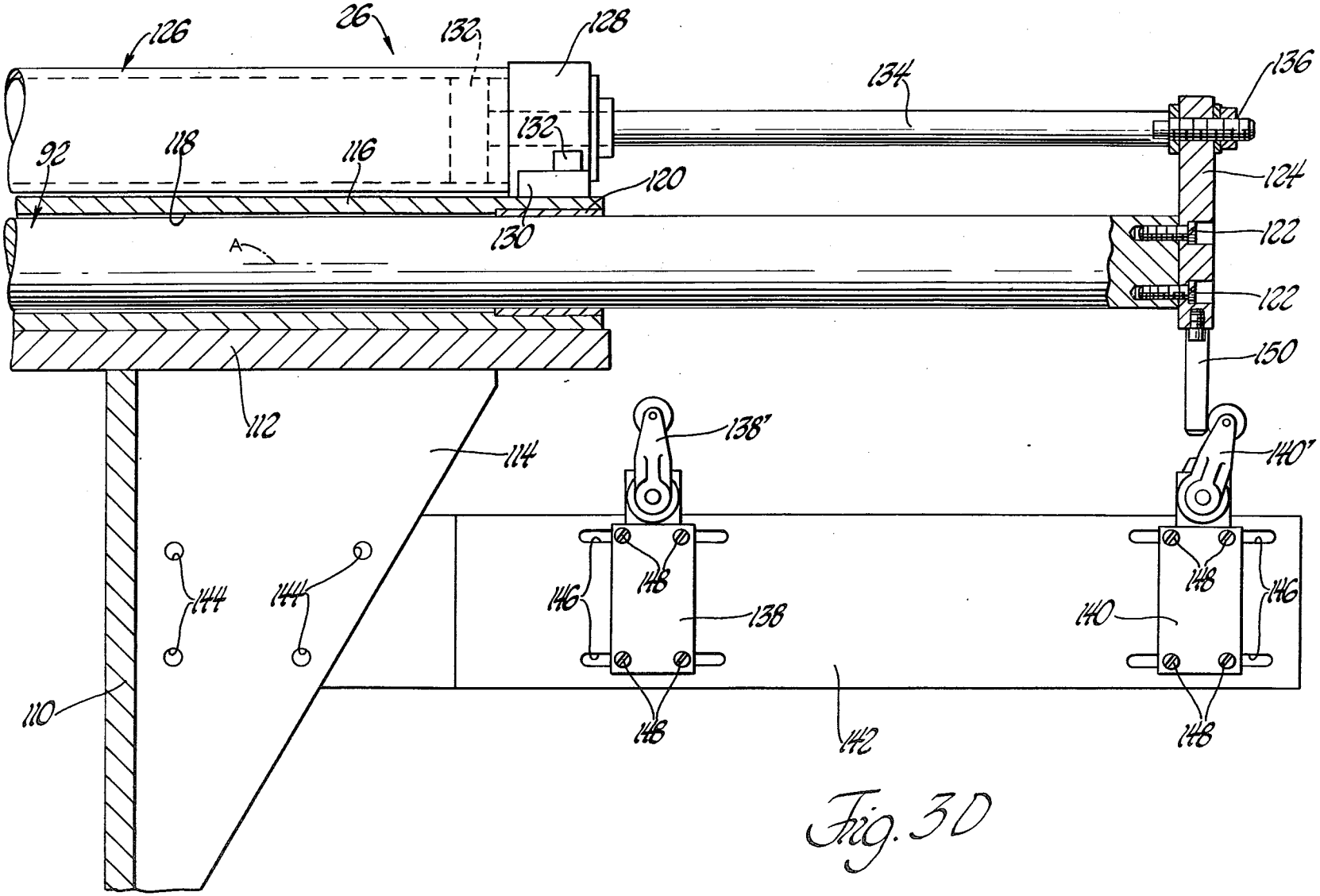

Movement of the loading member 92 shown in FIGS. 3C and 3D to the right and to the left under the impetus of the actuator cylinder 126 is controlled by a pair of limit switches 138 and 140. A support plate 142 secured to the bracket plate 114 by rivets 144 includes elongated slots 146 through which bolts 148 extend for connection to nuts that are not shown. Tightening and loosening of the bolt and nut connections between the switches 138 and 140 and the plate 142 provides adjustable mounting of the switches in a left-right direction so as to accommodate for splining of different power transmission members requiring different lengths of movement during the loading and unloading. A switch tripper 150 on the plate 124 extends downwardly between switch arms 138' and 140' of the switches. Switch 138 is tripped upon movement of the loading member 92 to its left axial extreme as the clutch hub 100 is loaded onto the mandrel 20, while switch 140 is tripped upon movement of the loading member to its right axial extreme after movement of the splined hub back to indexer 102. Both of these switches 138 and 140 are connected to suitable hydraulic controls to actuate the loading member cylinder 126 in coordination with the controls for the machine apparatus being operated.

Machine apparatus 10 shown in FIGS. 3A and 3B includes an antifriction spindle assembly 152 receiving the loading member 94 between upper and lower table mounts 154 and 156 to which the upper and lower die racks 12 and 14 are respectively secured. A number of bolts 158 secure the upper rack 12 to the table mount 154 with a spacer 160 positioning the rack so that its downwardly facing toothed forming face 22 is in alignment with the mandrel 20 for meshing with the mandrel teeth 108. A pair of spacers 162 located on the opposite sides of a timing rack 164, whose function will be described later, properly locates the lower rack 14 which is secured by a number of bolts 166 to the lower table mount 156 so that its toothed forming face 24 meshes with the mandrel teeth 108. Upper table mount 154 is mounted on an upper slide table similar to the lower slide table 168 shown. A slideway 170 supports the slide table 168 on the lower machine base 18 with slide projections 172 of the table slidably positioned below slide retainers 174 that are bolted to the lower machine base.

The antifriction spindle assembly 152 shown in FIG. 3B includes a spindle housing 176 secured by a number of spaced bolts 178, only one shown, to a base support 180. An upwardly projecting extension 184 of the lower machine base 18 includes an opening 186 through which the base support 180 extends projecting to the right and the left and secured by a plurality of spaced bolts 187, only one of which is shown. Spindle housing 176 projects into the right end of support 180 and includes a central opening 188 in which a spindle 190 is rotatably supported along axis A by an antifriction roller bearing 192 and a double-row antifriction tapered roller bearing 194. Suitable retainer clips 196 snap into grooves in the spindle housing 176 and the spindle 190 so as to retain the roller bearing 192 against movement to the left, while the outer and inner races 198 and 200 thereof which contact the roller elements 202 engage axially facing surfaces 204 and 206 of the spindle housing and the spindle to prevent movement toward the right. Tapered roller bearing 194 has an outer race 208 that is secured between a spindle housing annular surface 209 that faces axially toward the right and a ring 212 that is secured to the spindle housing by circumferentially spaced bolts 214. An annular step 216 of the spindle 190 is slidably engaged by an elastomeric seal 218 carried by the ring 212. An axial face of step 216 engages the right inner race 220 to maintain contact between the right tapered roller elements 222 and the right face of the outer race 208. Similarly, a lock nut 224 threaded onto the spindle 190 engages the left inner race 226 in order to maintain engagement thereof with the left tapered roller elements 228 that roll against the left face of the outer race 208.

Spindle 190 shown in FIG. 3B includes an annular flange 230 and a mounting end 232 which is secured to flange 230 by a plurality of circumferentially spaced bolts 234, only one of which is shown. Spindle end 232 includes an annular projection 236 received within a central opening 238 of the mandrel 20 and also includes a larger diameter projection 240 received within a central opening 242 of a timing gear 244. A plurality of circumferentially spaced bolts 246, only one shown, secure the mandrel 20 and the timing gear 244 to the spindle mounting end 232 so that each rotates with the spindle. Timing rack 164 which is secured to the lower die rack 14 has an upwardly facing toothed surface that meshes with teeth 247 of the timing gear 244 so that the mandrel 20 is rotated in coordination with the movement of the die racks 12 and 14.

Unloading member 94 of loader 26 is received within the central opening 238 of mandrel 20 as shown in FIG. 3B supported for axial sliding movement along axis A by a bearing 248 pressed into the mandrel opening. The unloading member 94 extends through the timing gear 244 whose opening 242 is aligned with the mandrel opening and through a spindle end opening 249 which is also aligned with the mandrel opening along axis A. A shaft 250 of unloading member 94 extends through an opening 254 of the spindle and is secured by a threaded connection 256 to the loading member just to the right of the double-row tapered roller bearing 194. A bearing 258 pressed into the right end of spindle opening 254 cooperates with the bearing 248 in slidably supporting the unloading member 94 and shaft 250 thereof for axial movement along axis A. Shaft 250 extends through a cavity 260 in a headstock housing or base support 180 and has a left end secured by a thrust bearing 262 to a quill-type coupling member 264. A quill slide housing 266 is secured to the base support 180 by a plurality of circumferentially spaced bolts 268, only one shown, and includes a central bore 270 that slidably receives the coupling member 264. An opening 272 in a stationary base plate 274 receives the base support 180 to reinforce its mounting.

An actuating cylinder support housing 276 shown in FIG. 3A includes a plate 278 secured by bolts 280 to the base plate 274. Housing 276 also includes a pair of spaced side plates 282, only one shown, that are connected by an end plate 284. An actuator in the form of a hydraulic cylinder 286 is mounted on the end plate 284 with an end ring projection 288 of the cylinder received within a hole 290 through the end plate. Cylinder 286 includes a central bore that receives a piston 292 in a sealingly slidable relationship for movement to the left and to the right along the axis A of mandrel rotation. A connecting rod 294 of the piston extends outwardly through the right end of the cylinder and is secured to a connector 296 mounted in a suitable manner on the left end of the coupling member 264. During loading of a clutch hub onto the mandrel 20 by the loader 26, hydraulic fluid on the left side of the piston 292 is allowed to flow through a control valve to a reservoir as fluid is pumped to the right side of the piston in a coordinated manner with the loading member cylinder actuation previously described. The rate at which the fluid is allowed to return to the reservoir from the left side of the piston 292 is limited so that there is some resistance to this movement in order to allow the enlarged end 98 of the unloading member 94 to engage the clutch hub 100 being loaded in a cooperable clamping action with the rotatable clamp 96. During unloading, the fluid on the right side of piston 292 is likewise allowed to flow to the reservoir at a controlled rate as fluid is pumped to the left side of the piston to move the unloading member 94 to the right so that its enlarged end 98 removes a splined clutch hub from the mandrel 20 and returns it to the indexer 102.

A pair of limit switches 298 and 300 are mounted on the side plate 282 shown in FIG. 3A by bolts 302 extending through elongated slots 304 in the side plate and connected to unshown nuts on its opposite side. Switch arms 298' and 300' of the switches are located on opposite sides of a switch tripper 304 which is secured to the left end of the coupling member 264 by a nut 306. Switch arm 298' is actuated by the tripper 304 to sense the left extreme of axial unloading member movement upon loading of a clutch hub on the mandrel prior to its splining. Switch arm 300' is moved by the tripper 304 to sense the right extreme of axial unloading member movement as a splined member is returned to the indexer 102. Adjustment of the switches along the length of the slots 304 allows the loading and unloading members to move different distances as may be required by the length of the particular member being splined. Sensing of the switches 298 and 300 is coupled through suitable control circuitry with the sensing of the switches 138 and 140 shown in FIG. 3D so that clutch hubs being loaded or unloaded are clamped between the rotatable clamp 96 of the loading member 92 and the enlarged end 98 of the unloading member during movement between the indexer 102 and the mandrel 20.

During splining of a clutch hub 100 loaded on the mandrel 20, the loading member shaft 250 rotates with the mandrel while the coupling member 264 shown in FIG. 3A is prevented from rotating by the cooperable action of an axial keyway 308 thereof and a key 310 on the end of a bolt 312 that is threaded into the slide housing 266. The coupling member 264 can slide axially during the loading and unloading due to the elongated extent of the keyway 308 in this direction. Shaft 250 is allowed to rotate with the coupling member 264 fixed against rotation due to the thrust bearing 262 which is received within a hole 314 in the right end of the coupling member. A reduced diameter extension 316 of shaft 250 extends through the thrust bearing 252 and is threaded to a nut 317 that clamps the thrust bearing against an axial facing annular shoulder 317 of the shaft. Bearing races 318 are maintained in rolling engagement with the ball elements 320 by the nut and shoulder clamping. A retainer ring 322 is secured to the right end of the coupling member 264 by bolts 324 so as to engage the right bearing race 318 and thereby retains the thrust bearing 262 against movement to the right relative to the coupling member. The axial coupling member hole 314 in which the thrust bearing 262 is received includes a shoulder 326 that engages the left bearing race 318 to prevent relative movement of the bearing to the left with respect to the coupling member.

The left end of loading member 92 includes a projection 328 shown in FIG. 3C with an end 330 threaded into an axial hole in the loading member so as to be secured by a jam nut 332. Projection 328 includes an annular flange 334 whose center axis is coincident with the axis A of mandrel rotation. A pair of antifriction thrust bearings 336 are positioned on opposite sides of the flange 334 and have respective races 338 engaged with its opposite sides. The other race 338 of the left bearing 336 is engaged with an axial surface 340 of the clamp hole in which the bearings are received. A retainer ring 342 is secured to the clamp 96 by bolts 344 to maintain engagement of the races 338 with the ball elements 346 of the bearings. A seal 348 carried by ring 342 seals against the loading member projection 328 during rotation of the clamp supported by the bearings 336 along axis A. Clamping pressure can be applied by the clamp 96 pushing to the left and resisting pushing to the right by the cooperable action of the thrust bearings 336 and the annular flange 334.

Mandrel 20 shown in FIG. 3B includes an annular clamping surface 350 that faces to the right, while the rotatable clamp 96 shown in FIG. 3C includes an annular clamping surface 352 that faces toward the left. Clamping surfaces 350 and 352 are aligned with each other so as to clamp the clutch hub end wall 104 with the sleeve 106 thereof positioned over the mandrel teeth 108 between the upper and lower dies 12 and 14. This clamping action positions the clutch hub prior to and during the splining which is performed on the sleeve 106 by the die racks.

A centering mechanism of the apparatus includes a tapered probe 354 shown in FIG. 3C on the rotatable clamp 96 of the loading member located centrally within its annular clamping surface 352 and also includes a tapered hole 356 located centrally within the enlarged end 98 of the unloading member facing toward the right as shown in FIG. 3B. A helical spring 358 biases the probe 354 resiliently toward the left and a retainer ring 360 secured to the clamp by bolts 362 limits the extent of probe movement toward the left. A centering action is provided between the clamp 96 and the enlarged end 98 of the unloading member by the probe 354 as it is received within the hole 356. An annular centering surface 364 of the unloading member end 98 is received within a central opening defined by the annular end wall 104 of the clutch hub 100 to insure proper positioning thereof centrally on the mandrel 20 during the splining. An axially facing annular clamping surface 366 of unloading member end 98 cooperates with the clamping surface 352 of the clamp 96 to clamp the clutch hub end wall 104 during movement of the clutch hub back and forth between the indexer 102 and the mandrel 20. A central depression 368 of the mandrel 20 extends about its opening 238 and receives the enlarged end 98 of the loading member upon axial movement thereof to the left as shown in FIG. 3B so that the clamping surface 366 is located to the left of the mandrel clamping surface 350 in order to permit the clamping surface 352 of the clamp 96 to cooperate therewith in clamping the clutch hub being splined.

A guide indicated generally by 368 in FIG. 3C preferably includes a guide tube 370 mounted by a bracket 372 that is secured by bolts 374 to the lower machine base 18. Guide tube 370 is aligned with the axis of mandrel rotation, with its left end opening to the mandrel 20, and with its right end opening to the upper extremity of the indexer 102 adjacent the rotatable clamp 96 of the loading member 92.

Figure 4:
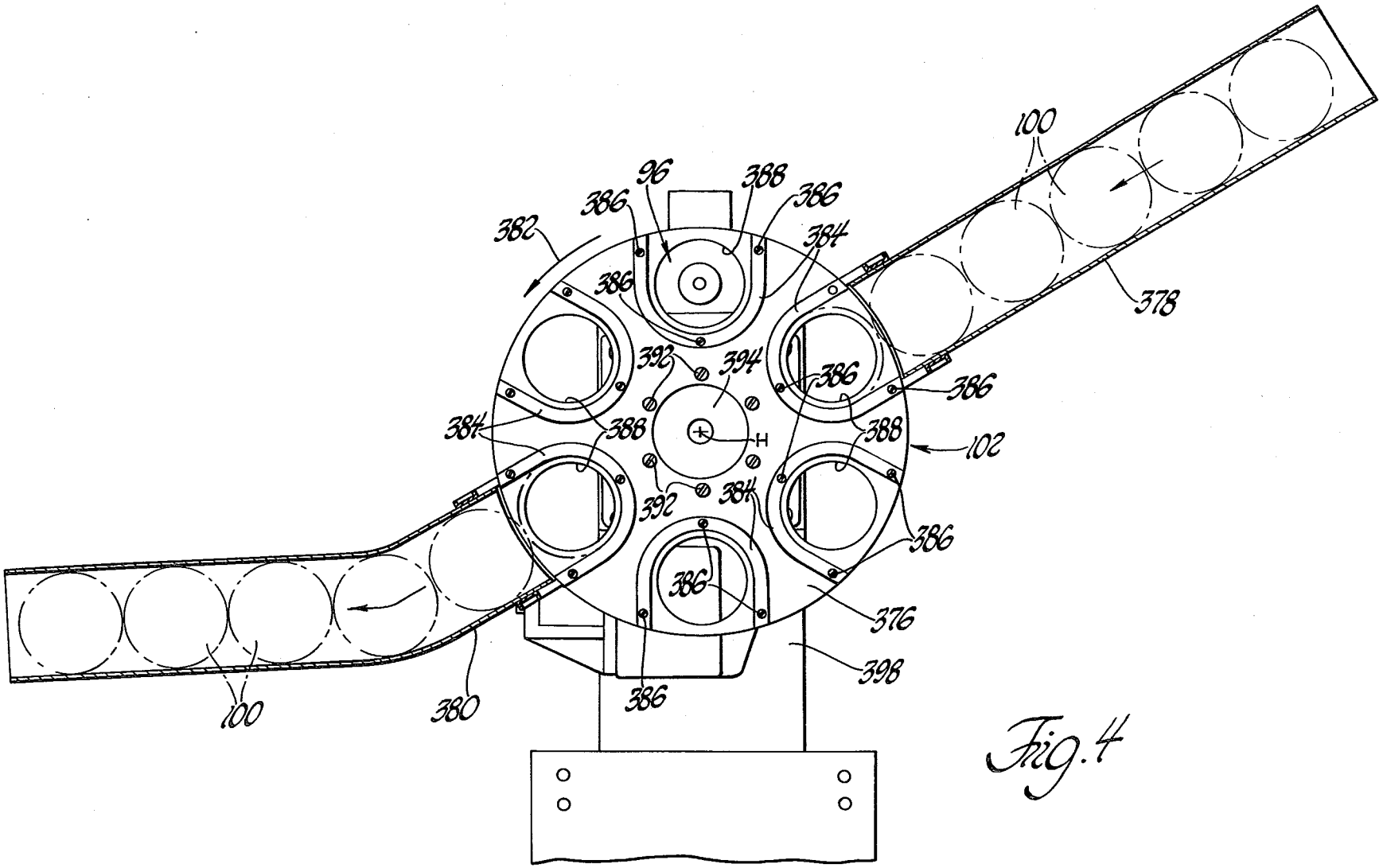
FIG. 4 is an elevation view taken along line 4—4 of FIG. 3C and illustrates an indexer of the machine apparatus.

As seen by combined reference to FIGS. 3C and 4, the indexer 102 includes a rotatable indexing table 376, an inclined input chute 378 that feeds clutch hubs 100 to be splined to the table 376 and an inclined output chute 380 that receives the splined members from the table 376 for delivery to a suitable bin. Table 376 is rotated counterclockwise as shown by arrow 382 in FIG. 4 about axis H and includes six U-shaped retainers 384, only one of which is shown in section at the upper extremity of the table in FIG. 3C. Each retainer 384 is secured to the table 376 by three bolts 386 about an associated round hole 388 through the table. Retainers 384 have a sufficient axial length as can be seen by the one retainer shown in FIG. 3C so as to receive and position the clutch hubs received therein from the input chute 378 upon indexing rotation. Upon alignment of each retainer 384 with the rotatable clamp 96 of the loading member, the loading and unloading members are moved axially in the manner previously described to move a clutch hub to be splined from the indexer through the guide tube 370 and onto the mandrel 20 for splining. After splining is completed, the loading and unloading members move the splined clutch hub back to the retainer from which it was originally taken and the indexer is then actuated to rotate its table 376 another 1/6 of a turn so that the next clutch hub to be splined is in position aligned with the rotatable clamp 96 of the loading member. As the indexing table 376 rotates about its axis H each 1/6 turn, one of the retainers 384 carrying a previously splined clutch hub is moved into alignment with the inclined output chute 380 which then receives the splined clutch hub for rolling into the storage bin. Table 376 is rotatably supported along axis H as best shown in FIG. 3C by a plate 390 to which it is secured by circumferentially spaced bolts 392. A rotatable shaft 394 is received within a hole 396 in the table 376 and is splined to the plate 390 to provide indexing rotation thereof through a suitable actuator mounted within a housing 398 of the indexer.

A more complete description of the operation of loader 26 with the rotary embodiment of the machine apparatus 30 shown in FIG. 2 will not be given. In connection with this description, reference should be made not only to FIG. 2 but to FIGS. 5A and 5B collectively with FIGS. 3C and 3D, all of which should be arranged alphabetically from the left to the right. Machine apparatus 30 is supported on a lower machine base 400 by a pair of upwardly extending front and rear spindle housing support plates 402 and 404 as well as by an upwardly extending differential support plate 406 and inclined supports 408 and 410. Front and rear support plates 402 and 404 support an antifriction spindle assembly 412 that rotatably supports the spindle 70 on which the toothed mandrel 32 is mounted for rotation along axis A.

Figure 5A:
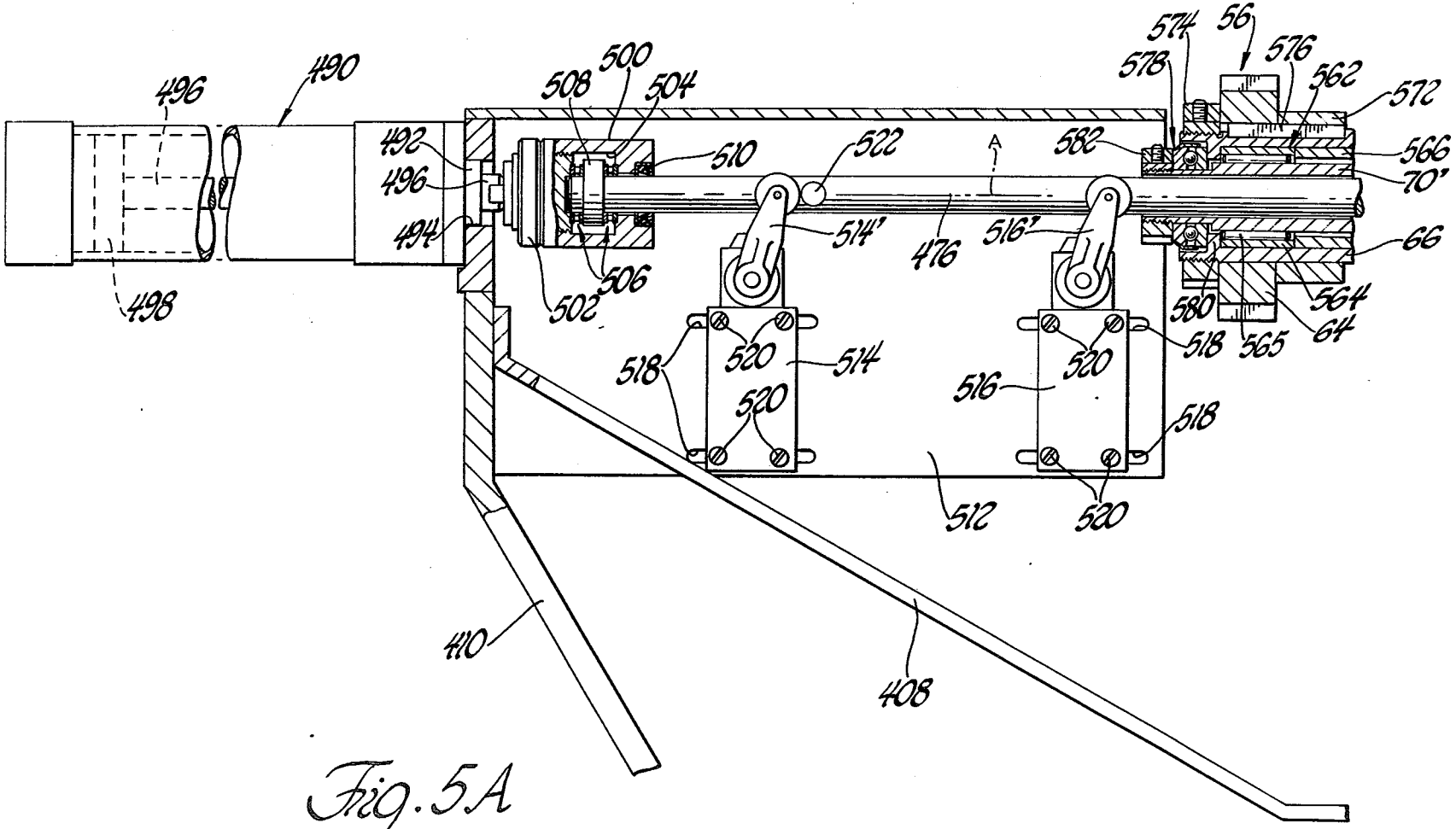
FIGS. 5A and 5B placed together alphabetically from the left to the right are taken along line 5—5 of FIG. 2 and, placed to the left of FIGS. 3C and 3D in alphabetical order from the left to the right, collectively show the complete machine apparatus of this embodiment.
Figure 5B:
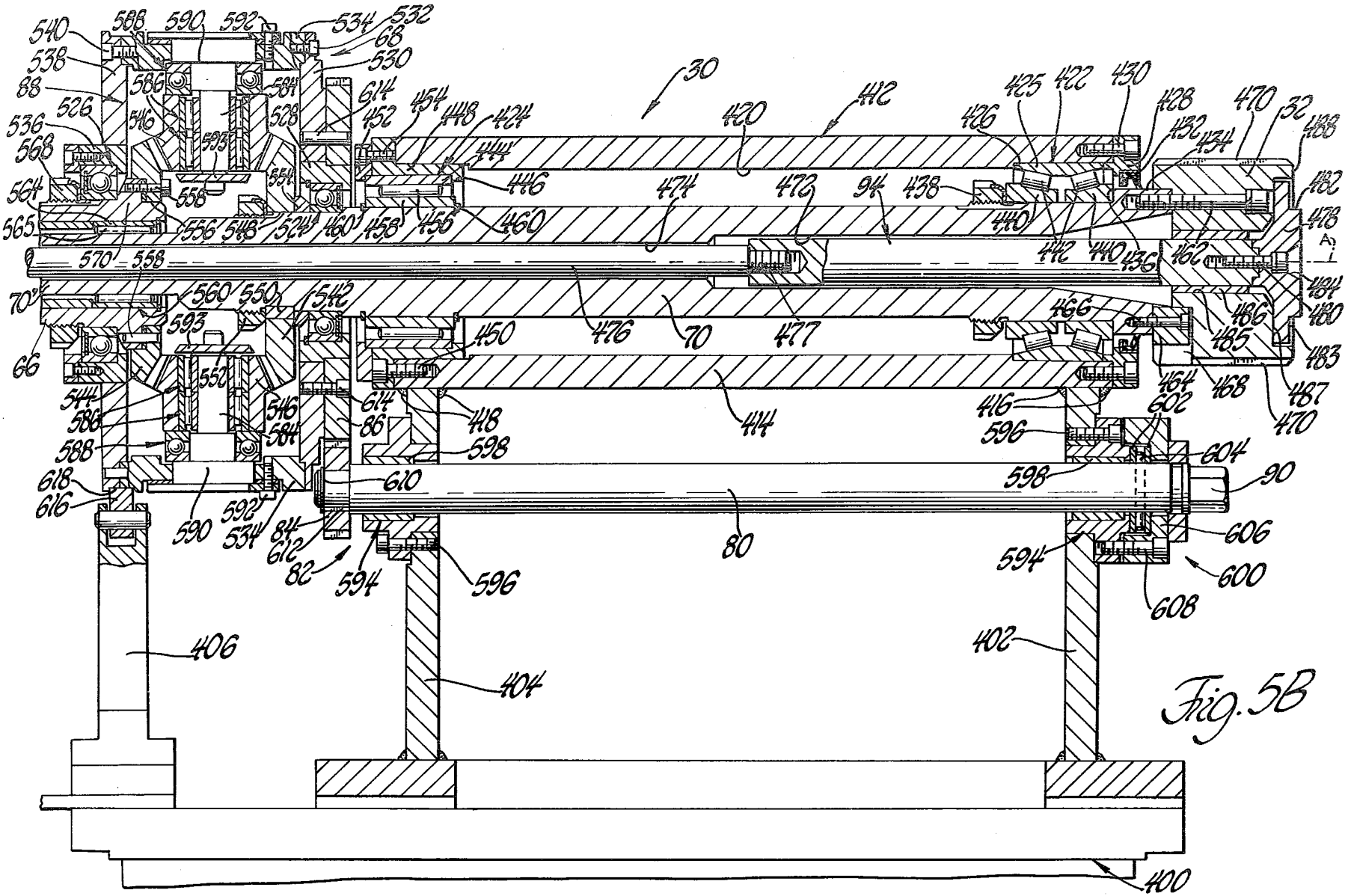

Antifriction spindle assembly 412 as shown in FIG. 5B includes a hollow tubular spindle housing 414 having a front end secured to the front support plate 402 by welds 416 and a rear end secured to the rear support plate 404 by welds 418. Within an elongated cavity 420 of the housing 414, a front antifriction double-row tapered roller bearing 422 and a rear antifriction roller bearing 424 cooperate to rotatably support the spindle 70. An outer race 425 of bearing 422 is positioned axially along axis A between a shallow depression shoulder 426 and a retaining ring 428 secured to the spindle housing by bolts 430. Retaining ring 428 mounts a seal 432 that slides against an enlarged diameter flange 434 of spindle 70. An axially facing surface 436 of spindle flange 434 and a lock nut 438 respectively engage the inner races 440 of bearing 422 so as to maintain rolling engagement of the tapered roller elements 442 with the inner and outer races. The rear antifriction roller bearing 424 includes an outer race 444 whose front end is engaged with an annular flange 446 of a bearing retainer housing 448 that is secured to spindle housing 414 by a plurality of circumferentially spaced bolts 450, only one of which is shown. A retainer ring 452 engages the rear end of the outer race 444 and is secured to the retainer housing 448 by a plurality of circumferentially spaced bolts 454, only one of which is shown. Roller elements 456 roll between the outer race 444 and an inner race 458 whose front and rear ends are respectively secured by a pair of ring clips 460 positioned within annular grooves in the spindle 70. Antifriction bearings 422 and 424 thus rotatably support spindle 70 while generating little frictional resistance. Mandrel 32 is secured to the front spindle flange 434 by a number of circumferentially spaced bolts 462, only one of which is shown, and is rotatably positioned by a key 464 secured to the spindle by a bolt 466 within a mandrel keyway slot 468. The mandrel teeth 470 extend outwardly in a radial direction concentric about the rotational axis A.

Loader 26 shown in FIGS. 3C and 3D operates with machine apparatus 30 in a similar manner to the other embodiment previously described and the unloading member thereof shown in FIG. 5B is thus indicated by the same general reference numeral 94. A central opening 472 of spindle 70 receives the unloading member while a reduced diameter portion 474 of the opening receives an unloading member shaft 476 having a threaded connection 477 to the rest of the unloading member. An enlarged front end 478 of the unloading member is secured by a bolt 480 and includes an annular centering surface 482 and an annular clamping surface 483 as well as a tapered centering hole 484. Unloading member 94 is movable axially to the left and the right along axis A within a central opening 485 of mandrel 32 and is supported by a bushing 486 pressed into the mandrel opening. Upon axial movement to the left, the enlarged end 478 of the unloading member is received within a central mandrel depression 487 about the mandrel opening and remains there during splining of a power transmission member whose sleeve is mounted over the mandrel teeth 470 to be splined in the manner previously described in connection with FIG. 2. An annular clamping surface 488 of mandrel 32 extends about the depression 487 and cooperates with the rotatable clamp 96 of the loader 26 to clamp the end wall of the member being splined in the same manner described in connection with the other straight rack embodiment. Centering surface 482 and centering hole 484 also function in the same manner previously described.

Axial movement of the unloading member 94 shown in FIG. 5B along the axis of mandrel rotation A is controlled by an actuator in the form of a hydraulic cylinder 490 shown in FIG. 5A. An end ring projection 492 of cylinder 490 is fixedly mounted within an opening 494 of the base support 410 with a connecting rod 496 of a cylinder piston 498 extending outwardly through the projection to the right. Unloading member shaft 476 is secured to the piston rod 496 by a coupling member 500. A cap 502 of the coupling member is secured to the end of the rod 496 and threaded into the coupling member whose central cavity 594 receives a pair of antifriction thrust bearings 506 located on the opposite sides of an annular flange 508 of unloading member shaft 476. As hydraulic fluid is supplied to the opposite sides of the piston 498 to provide axial movement of the unloading member 94 along the axis of mandrel rotation A, the thrust bearings 506 allow rotation of the unloading member while providing the connection that supplies the impetus for the axial movement. During this rotation, a seal 510 of the coupling member engages the unloading member shaft 476 to prevent entry of foreign particles into the cavity 504 containing the thrust bearings.

A plate 512 shown in FIG. 5A is mounted on the base supports 408 and 410 and a pair of limit switches 514 and 516 are adjustably supported on this plate. Elongated slots 518 in plate 512 receive bolts 520 that are threaded into unshown nuts on the other side of the plate so as to adjustably mount the switches for movement to the left and the right. Switch arms 514' and 516' are operated by a switch tripper 522 on the unloading member shaft 476 in response to axial movement of the unloading member 94 during loading and unloading. Arm 514' senses the extreme axial movement of the unloading member to the left upon the loading of a member to be splined on the mandrel, while arm 516' senses the extreme axial movement of the unloading member to the right upon movement of a splined member back to the indexer. The switches 514 and 516 are coupled through suitable controls with the switches 138 and 140 shown in FIG. 3D so that the loading and unloading members 92 and 94 cooperate in moving the power transmission members such as the clutch hubs 100 shown in FIG. 3C back and forth between the indexer 102 and the mandrel 32 in the same manner previously described in connection with the other embodiment.

With reference to FIG. 5B, a housing 88 of differential 68 is fixed against rotation by the timing adjustment drive train 82 in a manner that is described later in more detail. An antifriction ball bearing 524 rotatably supports the spindle 70 with respect to the differential housing while an antifriction ball bearing 526 provides a rotatable support between the differential housing and the drive sleeve 66 connected to the gear 64 of the timing gear drive train 56 that is driven in the manner previously described in connection with FIG. 2. The ball bearing 524 is secured between a clip and a shoulder of an insert 528 that is pressed into one end plate 530 of the differential housing. Bolts 532 secure housing end plate 530 to an annular housing ring 534. Ball bearing 526 is secured between a flange and a bolted retainer ring of an insert 536 that is pressed into another differential housing end plate 538 that is also secured to the housing ring 534 by bolts 540.

Differential 68 shown in FIG. 5B includes a side gear 542 coupled for rotation with the spindle 70 and a side gear 544 coupled to the drive sleeve 66 which is itself driven by the timing gear drive train 56. Pinion gears 546 rotatably supported on the differential housing ring 534 are meshed with both of the side gears 542 and 544 and thereby drive the spindle 70 in the opposite direction the sleeve 66 is driven. Side gear 542 includes a central opening 548 through which the spindle 70 and the unloading member shaft 476 therein extend rearwardly to the cylinder 490 shown in FIG. 5A. A key 550 rotatably couples the side gear 542 to the spindle 70 with a lock nut 552 providing axial positioning in cooperation with a thrust ring 554 interposed between this side gear and the inner race of the ball bearing 524. The central opening 556 of the other side gear 544 receives the spindle 70 and unloading member shaft 476 therein which extend rearwardly to the cylinder 490. Bolts and pins 558 fix the side gear 544 to the right end of sleeve 66 and an antifriction roller bearing 560 at the right sleeve end rotatably supports the reduced diameter portion 70' of the spindle. An antifriction roller bearing 562 supports the reduced diameter spindle portion 70' at the left end of sleeve 66. Bearings 560 and 562 have respective outer races 564 spaced from each other by a tubular insert 566 within sleeve 66. Roller elements 565 roll between the outer races 564 of these bearings and the spindle portion 70'. A lock nut 568 threaded onto the right end of sleeve 66 engages the inner race of bearing 526 to retain it against a sleeve end flange 570. Similarly, an annular ring 572 pressed over the left end of the sleeve 66 cooperates with a screw-tightened ring 574 to axially position the timing gear 64 along the sleeve while a key 576 rotatably fixes the sleeve to this gear. A thrust ball bearing 578 is seated against an annular end flange 580 of sleeve 66 and retained by a screw-tightened ring 582 on the threaded end of spindle portion 70' to maintain an axially positioned relationship.

Pinion gears 546 of the differential 86 are mounted on respective shafts 584 by roller bearings 586 and by thrust ball bearings 588 adjacent enlarged ends 590 of the shafts. Bolts 592 secure the shaft ends 590 to the annular housing ring 534. Retainers 593 on the inner ends of shafts 584 maintain the pinion gears 546 thereon prior to assembly.

As seen in FIG. 5B, the timing adjustment drive train 82 includes front and rear sleeve bearings 594 mounted on the plates 402 and 404 by bolts 596 and having sleeves 598 that rotatably support the opposite ends of adjustment shaft 80. A brake 600 adjacent the hex head 90 of the shaft is operable to selectively allow or prevent shaft rotation. An annular brake pad 602 has radial holes that receive the ends of a pin 604 which extends through the shaft 80 so that a brake member 606 can be tightened by a number of bolts 608, only one of which is shown, in order to clamp the pad and thereby prevent shaft rotation or to unclamp the pad to allow this rotation. A clip 610 axially secures the gear 84 on the rear end of shaft 80 while a key 612 rotatably fixes the gear with respect to the shaft. Meshing of gear 84 with the gear 86 that is fixed on the differential housing by bolts and pins 614 rotates the differential housing 88 which is coupled to the spindle 70 through the pinion gears 546 and the one side gear 542. A slide support 616 on the upper end of support plate 406 is received by an annular track 618 of the differential housing to allow the housing rotation. While the spindle 70 and the mandrel 32 carried thereby are rotated during this differential housing rotation provided by the adjustment drive train 82, differential action takes place as the side gear 544 remains stationary with the sleeve 66 coupled to the timing gear 64 that is driven from one of the tool mounts 34 as shown in FIG. 2. As such, the mandrel 32 is rotated with respect to the tool mounts 34 to provide proper adjustment for meshing of the die and mandrel teeth in order to provide precise spline forming.

While two preferred embodiments of machine apparatus constructed according to the present invention have herein been described in detail, those familiar with this art will recognize various alternative designs and embodiments for practicing the present invention as defined by the following claims.

I claim:

1. Machine apparatus for splining thin-walled sleeves of power transmission members, the apparatus comprising: a toothed mandrel mounted for rotation about a central axis and having a central opening through which the central axis thereof extends; a pair of toothed dies mounted for movement on opposite sides of the toothed mandrel so as to mesh the die and mandrel teeth with the sleeve of a mandrel mounted member located therebetween and splined thereby as the meshing proceeds; a drive mechanism for rotating the mandrel and moving the dies in synchronization; and means for automatically mounting the members on the mandrel for splining and automatically removing the splined members from the mandrel, said means including an unloading member that extends through the opening of the mandrel and which is supported for axial movement so as to remove a power transmission member therefrom after splining thereof has taken place.

2. Machine apparatus for splining thin-walled sleeves of power transmission members, the apparatus comprising: a toothed mandrel mounted for rotation about a central axis; a pair of toothed dies mounted for movement on opposite sides of the toothed mandrel so as to mesh the die and mandrel teeth with the sleeve of a mandrel mounted member located therebetween and splined thereby as the meshing proceeds; a drive mechanism for rotating the mandrel and moving the dies in synchronization; a loader having a loading member mounted for axial movement along the central axis of mandrel rotation so as to automatically mount members to be splined on the mandrel; the axially movable loading member including a rotatable clamp that cooperates with the mandrel to clamp a member being splined while rotating therewith; and the loader including an unloading member mounted for axial movement along the central axis of mandrel rotation so as to remove the members from the mandrel after the splining.

3. Apparatus as in claim 2 further including an actuator for moving the loading member axially, an antifriction thrust bearing that rotatably connects the loading member and the rotatable clamp, an actuator for moving the unloading member axially, said actuators moving the loading and unloading members in coordination with each other to carry a member therebetween to and from the mandrel, an antifriction splindle assembly that rotatably mounts the mandrel and the unloading member for rotation with each other, and a bushing that mounts the unloading member for axial movement through the mandrel along the axis of rotation thereof.

4. Apparatus as in claim 3 wherein the unloading member includes an annular centering surface for properly positioning a member being splined on the mandrel, and a centering mechanism for aligning the clamp of the loading member and the unloading member during the splining.

5. Apparatus as in claim 3 wherein the centering mechanism includes a spring biased probe mounted on the rotatable clamp of the loading member and the centering mechanism also including a hole in the unloading member for receiving the probe.

6. Apparatus as in claim 2 further including an indexer for feeding members to be splined to the loader and for receiving splined members therefrom, and a guide that guides movement of the members between the indexer and the mandrel.

7. Apparatus as in claim 6 wherein the indexer includes a rotatable table with circumferentially spaced retainers for positioning members on the table, an input chute for feeding members to be splined to the table, and an output chute for receiving splined members from the table.

8. Apparatus as in claim 2 wherein the dies include generally straight forming faces having the die teeth that spline the members, and the drive mechanism including a synchronizing gear mounted for rotation with the mandrel and a synchronizing rack fixed for movement with one of the dies and meshed with the synchronizing gear to coordinate the mandrel rotation with the die movement.

9. Apparatus as in claim 2 wherein the dies include curved forming faces, a pair of tool mounts that support the dies and which are rotatably driven by the drive mechanism, the drive mechanism including a timing gear drive train driven with one of the tool mounts, the drive mechanism also having a differential including an input driven by the timing gear drive train and an output that rotates the mandrel in coordination with the tool mounts and the dies supported thereon; and a timing adjustment drive train for rotating the mandrel through the differential with respect to the tool mounts.

10. Machine apparatus for splining thin-walled sleeves of power transmission members, the apparatus comprising: a toothed mandrel having a central opening; an antifriction spindle assembly that mounts the mandrel for rotation about a central axis; a synchronizing gear mounted for rotation with the mandrel; a pair of dies mounted for movement on the opposite sides of the toothed mandrel; said dies having straight forming faces with teeth spaced therealong for meshing with the mandrel teeth with the sleeve of a mandrel mounted member located therebetween and splined thereby as the meshing proceeds; a drive mechanism for moving the dies in coordination with each other; a synchronizing rack fixed for movement with one of the dies and meshed with the synchronizing gear to coordinate mandrel rotation with movement of the dies; a loader including a loading member and an actuator that moves the loading member axially along the axis of mandrel rotation to mount members to be splined on the mandrel; the loading member including a clamp mounted thereon so as to cooperate with the mandrel in clamping a member being splined while rotating with the mandrel; and the loader including an unloading member that extends through the opening of the mandrel and also including an actuator that moves the unloading member axially along the axis of mandrel rotation to remove a member therefrom after splining.

11. Apparatus as in claim 10 wherein the antifriction spindle assembly includes a fixed spindle housing, antifriction bearings on the spindle housing spaced axially along the axis of mandrel rotation, a spindle rotatably supported by the antifriction bearings and having a mounting end that fixedly supports the mandrel along its axis of rotation, the synchronizing gear having an opening that receives the mounting end of the spindle located inwardly from the mandrel for rotation therewith, the spindle also having a central opening aligned with the central opening of the mandrel in which the unloading member is received, the unloading member including a shaft extending therefrom through the spindle opening, a bushing that supports the unloading member and shaft thereof for axial movement through the mandrel and spindle openings, the unloading member actuator including a hydraulic cylinder, and a thrust bearing that connects the unloading member cylinder to the unloading member shaft.

12. Apparatus as in claim 11 further including a coupling member having one end that supports the thrust bearing connected to the unloading member shaft and another end connected to the unloading member cylinder, and a pair of adjustable limit switches mounted adjacent the coupling member and operated by axial movement of the coupling member to control operation of the cylinder connected thereto.

13. Apparatus as in claim 11 wherein the unloading member includes an enlarged end with an annular centering surface for properly locating a member being splined on the mandrel, the mandrel including an end with an annular clamping surface that faces in an axial direction along the axis of mandrel rotation, the mandrel including an axial depression within the annular clamping surface thereof and surrounding the central mandrel opening such that the depression receives the enlarged end of the unloading member upon axial movement thereinto.

14. Apparatus as in claim 13 further including an indexer for feeding members to be splined between the loading member and the mandrel and for receiving splined members therefrom, and a guide positioned between the indexer and the mandrel to guide members during mounting on and removal from the mandrel.

15. Apparatus as in claim 14 wherein the loader includes an antifriction thrust bearing that connects the loading member and clamp thereof, and the clamp including an annular clamping surface that faces axially along the axis of mandrel rotation to cooperate with the annular clamping surface of the mandrel to clamp a member being splined.

16. Apparatus as in claim 15 wherein the clamp includes a second antifriction thrust bearing, and a flange on the loading member located between the thrust bearings of the clamp.

17. Apparatus as in claim 16 further including a centering mechanism for centering the clamp of the loading member and the enlarged end on the unloading member, the centering mechanism including a probe mounted on the clamp within the annular clamping surface thereof, a spring that biases the probe toward the unloading member in a resilient fashion, and a hole in the enlarged head of the unloading member for receiving the probe.

18. Apparatus as in claim 17 wherein the loading member actuator includes a hydraulic cylinder, and a pair of adjustable limit switches operated by the axial movement of the loading member to control operation of the cylinder connected thereto.

19. Machine apparatus for splining thin-walled sleeves of power transmission members, the apparatus comprising: a toothed mandrel having an annular clamping surface and a central opening within the clamping surface; an antifriction spindle assembly including a spindle housing have spaced antifriction bearings and a spindle supported by said bearings; the spindle having a mounting end that mounts the mandrel for rotation about a central axis; a synchronizing gear having a central opening that receives the mounting end of the spindle in a fixed relationship inwardly from the mandrel so as to be mounted for rotation with the mandrel; the spindle having a central opening; a pair of dies mounted for movement on opposite sides of the toothed mandrel; said dies having straight forming faces with teeth spaced therealong for meshing with the mandrel teeth with the sleeve of a mandrel mounted member located therebetween and splined thereby as the meshing proceeds; a drive mechanism for moving the dies in coordination with each other; a synchronizing rack fixed for movement with one of the dies and meshed with the synchronizing gear to coordinate mandrel rotation with movement of the dies; a loader including a loading member having at least one antifriction thrust bearing mounted thereon; a clamp mounted on the loading member by the thrust bearing for rotation relative thereto about the central axis of the mandrel; the clamp having an annular clamping surface aligned with the clamping surface of the mandrel; a bushing that mounts the loading member for axial movement along the central axis; an actuator cylinder for moving the loading member axially toward and away from the mandrel; the clamping surfaces of the loading member clamp and the mandrel cooperating with the loading member moved toward the mandrel to clamp a member being splined while rotating therewith; an indexer for feeding members to be splined between the loader and the mandrel and for receiving splined members therefrom; a guide between the indexer and the mandrel for guiding members therebetween; the loader also including an unloading member received within the opening of the mandrel and having a shaft that extends through the spindle opening and an enlarged end adjacent the mandrel; a bushing that supports the unloading member for axial movement within the spindle and mandrel openings to cooperate with the loading member in mounting members to be splined on the mandrel and removing splined members therefrom; a thrust bearing connected to the unloading member shaft; a coupling member connected to the thrust bearing of the unloading member shaft; and an actuator cylinder that moves the coupling member and the unloading member axially along the axis of mandrel rotation.

20. Machine apparatus for splining thin-walled sleeves of power transmission members, the apparatus comprising: a toothed mandrel having a central opening; an antifriction spindle assembly that mounts the mandrel for rotation about a central axis; a pair of tool mounts supported for rotation about spaced axes on opposite sides of the mandrel; at least one pair of dies respectively mounted by the tool mounts and having associated curved forming faces with teeth spaced therealong for meshing with the toothed mandrel so as to mesh the die and mandrel teeth with the sleeve of a mandrel mounted member located therebetween and splined thereby as the meshing proceeds; a drive mechanism for rotating the tool mounts in coordination with each other; the drive mechanism including a timing gear drive train driven along with one of the tool mounts and a differential having an input driven by the timing gear drive train and an output driving the mandrel in coordination with the tool mounts; a timing adjustment drive train for rotating the mandrel through the differential with respect to the tool mounts; a loader including a loading member and an actuator that moves the loading member axially along the axis of mandrel rotation to mount members to be splined on the mandrel; the loader including a clamp that is mounted on the loading member so as to cooperate with the mandrel in clamping a member being splined while rotating with the mandrel; and the loader including an unloading member that extends through the opening of the mandrel and an actuator that moves the unloading member axially along the axis of mandrel rotation to remove a member therefrom after splining.

21. Apparatus as in claim 20 wherein the antifriction spindle assembly includes a fixed spindle housing, antifriction bearings on the spindle housing spaced axially along the axis of mandrel rotation, a spindle rotatably supported by the antifriction bearings and having an end that supports the mandrel, the spindle having a central opening that is aligned with the central opening of the mandrel to receive the unloading member; the unloading member including a shaft extending therefrom, a bushing that supports the unloading member and shaft thereof for axial movement, the unloading member actuator including a hydraulic cylinder, and a thrust bearing that connects the unloading member cylinder and the unloading member shaft.

22. Apparatus as in claim 21 wherein the differential includes a pair of side gears having aligned openings through which the spindle and unloading member shaft extend, the spindle being fixed to one side gear which is located closer to the mandrel than the other side gear, the spindle being rotatable with respect to said other side gear, a coupling member that connects the cylinder to the thrust bearing and thereby to the shaft of the unloading member, and a pair of adjustable limit switches operated by movement of the unloading member and shaft thereof to control operation of the unloading member cylinder.

23. Apparatus as in claim 22 wherein the timing gear drive train includes a drive sleeve through which the spindle and shaft extend, the drive sleeve including one end having an output gear of the timing gear drive train fixed thereto and other end fixed to the other side gear whose opening receives the spindle for rotation with respect to this side gear, and antifriction bearings that support the spindle and the drive sleeve for rotation with respect to each other.

24. Apparatus as in claim 23 wherein the differential includes pinion gears meshed with the side gears and a housing that rotatably supports the pinion gears and couples the timing adjustment drive train to the spindle and the mandrel, and means mounting the differential housing for rotation actuated by the timing adjustment drive train so as to thereby rotate the mandrel for timing adjustment with respect to the tool mounts.

25. Apparatus as in claim 24 wherein the timing adjustment drive train includes an adjustment shaft, a pair of spaced bearings that rotatably support the adjustment shaft, a brake adjacent one of the adjustment shaft bearings for selectively preventing rotation of the adjustment shaft, a gear on the adjustment shaft adjacent the other bearing thereof, and a gear fixed on the differential housing for rotation therewith and meshed with the adjustment shaft gear so as to rotate the differential housing with the brake released to thereby rotate the mandrel through the differential.

26. Apparatus as in claim 25 wherein the unloading member includes an enlarged end with an annular centering surface for properly locating a member being splined on the mandrel, the mandrel including an end with an annular clamping surface that faces in an axial direction along the axis of mandrel rotation, an axial depression in the mandrel within the annular clamping surface surrounding the central mandrel opening so as to receive the enlarged end of the unloading member upon axial movement thereinto.

27. Apparatus as in claim 26 further including an indexer for feeding members to be splined between the loading member and the mandrel and for receiving splined members therefrom, and a guide positioned between the indexer and the mandrel to guide members during mounting on and removal from the mandrel.

28. Apparatus as in claim 27 wherein the loader includes an antifriction thrust bearing that connects the loading member and clamp thereof, the clamp including an annular clamping surface that faces axially along the axis of mandrel rotation to cooperate with the annular clamping surface of the mandrel to clamp a member being splined, and the enlarged end of the unloading member including a clamping surface that cooperates with the clamping surface of the clamp in moving members between the indexer and the mandrel for splining.

29. Apparatus as in claim 28 wherein the clamp includes a second antifriction thrust bearing, and a flange on the loading member located between the thrust bearings of the clamp.

30. Apparatus as in claim 29 further including a centering mechanism for centering the clamp of the loading member and the enlarged end on the unloading member, the centering mechanism including a probe mounted on the loading member clamp within the annular clamping surface thereof, a spring that biases the probe toward the unloading member in a resilient fashion, and a hole in the enlarged end of the unloading member for receiving the probe.

31. Apparatus as in claim 30 wherein the loading member actuator includes a hydraulic cylinder, and a pair of adjustable limit switches operated by axial movement of the loading member to control operation of the cylinder connected thereto.

32. Machine apparatus for splining thin-walled sleeves of power transmission members, the apparatus comprising: a toothed mandrel having an annular clamping surface and a central opening within the clamping surface; an antifriction spindle assembly including a spindle housing having spaced antifriction bearings and a spindle supported by said bearings; the spindle having a central opening and a mounting end that mounts the mandrel for rotation about a central axis; a pair of tool mounts supported for rotation about spaced axes on opposite sides of the mandrel; at least one pair of dies respectively mounted by the tool mounts and having associated curved forming faces with teeth spaced therealong for meshing with the toothed mandrel so as to mesh the die and mandrel teeth with the sleeve of a mandrel mounted member located therebetween and splined thereby as the meshing proceeds; a drive mechanism for rotating the tool mounts in coordination with each other; the drive mechanism including a timing gear drive train driven along with one of the tool mounts and a differential having an input side gear driven by the timing gear drive train and an output side gear driving the spindle and the mandrel in coordination with the tool mounts; the differential side gears having openings through which the spindle extends; the differential including a housing and rotatable pinion gears supported by the housing and meshed with the side gears; means supporting the differential housing for rotation that rotates the spindle and the mandrel with respect to the tool mounts; a timing adjustment drive train including a gear fixed on the differential housing and a rotatable adjustment shaft having a gear fixed thereto and meshed with the gear on the differential housing; a brake for selectively preventing and allowing rotation of the adjustment shaft and consequent rotation of the mandrel through the differential housing; a loader including a loading member having an antifriction thrust bearing mounted thereon and a clamp mounted by the thrust bearing for rotation relative thereto about the central axis of the mandrel; the clamp having an annular clamping surface aligned with the clamping surface of the mandrel; a bushing that mounts the loading member for axial movement along the central axis; an actuator cylinder for moving the loading member axially toward and away from the mandrel; the clamping surfaces of the loading member clamp and the mandrel cooperating with the loading member moved toward the mandrel to clamp a member being splined while rotating therewith; an indexer for feeding members to be splined between the loader and the mandrel and for receiving splined members therefrom; a guide between the loader and the mandrel for guiding members therebetween; the loader also including an unloading member received within the opening of the mandrel and having a shaft that extends through the spindle opening and also having an enlarged end adjacent the mandrel; a bushing that supports the unloading member for axial movement within the spindle and mandrel openings to cooperate with the loading member in mounting members to be splined on the mandrel and removing splined members therefrom; a thrust bearing connected to the unloading member shaft; a coupling member connected to the thrust bearing of the unloading member shaft; and an actuator cylinder that moves the coupling member and the unloading member axially along the axis of mandrel rotation.

* * * * *